US011169470B2

(12) United States Patent
Miyake et al.

(10) Patent No.: US 11,169,470 B2
(45) Date of Patent: Nov. 9, 2021

(54) BELT DRIVING DEVICE WITH TILTABLE STEERING MEMBER

(71) Applicant: HEWLETT-PACKARD DEVELOPMENT COMPANY, L.P., Spring, TX (US)

(72) Inventors: Koji Miyake, Yokohama (JP); Satoru Hori, Yokohama (JP); Kensuke Nakajima, Yokohama (JP); Yuji Aoshima, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/760,594

(22) PCT Filed: Oct. 12, 2018

(86) PCT No.: PCT/KR2018/011998
§ 371 (c)(1),
(2) Date: Apr. 30, 2020

(87) PCT Pub. No.: WO2019/088493
PCT Pub. Date: May 9, 2019

(65) Prior Publication Data

US 2021/0223720 A1 Jul. 22, 2021

(30) Foreign Application Priority Data

Oct. 31, 2017 (JP) ..... JP2017-211084

(51) Int. Cl.
*G03G 15/16* (2006.01)

(52) U.S. Cl.
CPC ..... *G03G 15/1615* (2013.01)

(58) Field of Classification Search
CPC ..... G03G 15/1615; G03G 2215/00143; G03G 2215/00151; B65H 5/021
(Continued)

(56) References Cited

U.S. PATENT DOCUMENTS 7,136,611 B1 11/2006 Murase
8,792,812 B2 * 7/2014 Fujioka ..... G03G 15/755 399/312
(Continued)

FOREIGN PATENT DOCUMENTS

JP 4207269 10/2008
JP 2008268954 11/2008
(Continued)

*Primary Examiner* — William J Royer
(74) *Attorney, Agent, or Firm* — Staas & Halsey, LLP

(57) ABSTRACT

An imaging system includes a pair of belt rollers, a steering roller, a wheel, and a link mechanism. The pair of belt rollers includes a first roller and a second roller to drive an endless belt along a belt path. The steering roller is between the first roller and the second roller. The steering roller is tiltable to engage the endless belt. The wheel is at an end of the first roller in abutment with an edge of the endless belt, to move in an outward direction along a rotation axis of the first roller, when the endless belt shifts away from the belt path toward the wheel. The link mechanism is between the wheel and the steering roller to tilt the steering roller in response to a sliding movement of the wheel in the outward direction, to urge the endless belt to shift toward the belt path.

15 Claims, 12 Drawing Sheets

(58) Field of Classification Search
USPC ..... 399/302
See application file for complete search history.

(56) References Cited

U.S. PATENT DOCUMENTS

| | | | | |
|---|---|---|---|---|
| 10,322,893 | B2 * | 6/2019 | Nakajima | B65H 5/021 |
| 10,365,590 | B2 * | 7/2019 | Kudo | G03G 15/1615 |
| 2011/0070001 | A1 | 3/2011 | Morofushi | |
| 2012/0082489 | A1 | 4/2012 | Shirakata | |
| 2013/0084110 | A1 | 4/2013 | Fujioka | |
| 2016/0202640 | A1 | 7/2016 | Hatano | |
| 2020/0299083 | A1 * | 9/2020 | Miyake et al. | B65H 5/021 |
| 2021/0072671 | A1 * | 3/2021 | Aoshima et al. | G03G 15/1615 |

FOREIGN PATENT DOCUMENTS

| | | |
|---|---|---|
| JP | 2013101168 | 5/2013 |
| JP | 2013164507 | 8/2013 |
| JP | 2014-34447 | 2/2014 |
| JP | 2014106482 | 6/2014 |
| JP | 2014-178505 | 9/2014 |
| JP | 2016-9161 | 1/2016 |
| JP | 2016-128878 | 7/2016 |
| JP | 2016175729 | 10/2016 |
| JP | 2017-68112 | 4/2017 |

* cited by examiner

【Figure 1】
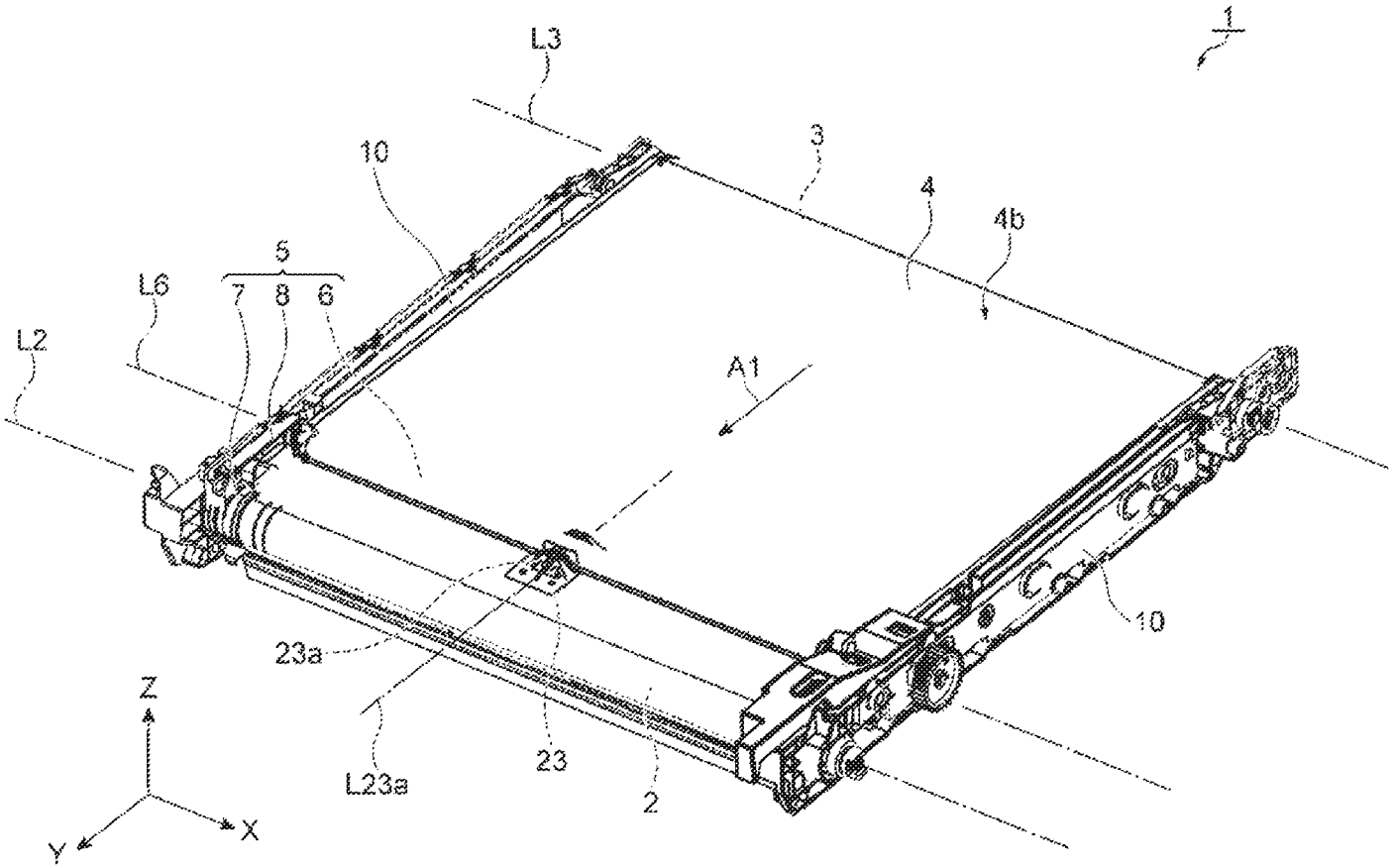

【Figure 2】
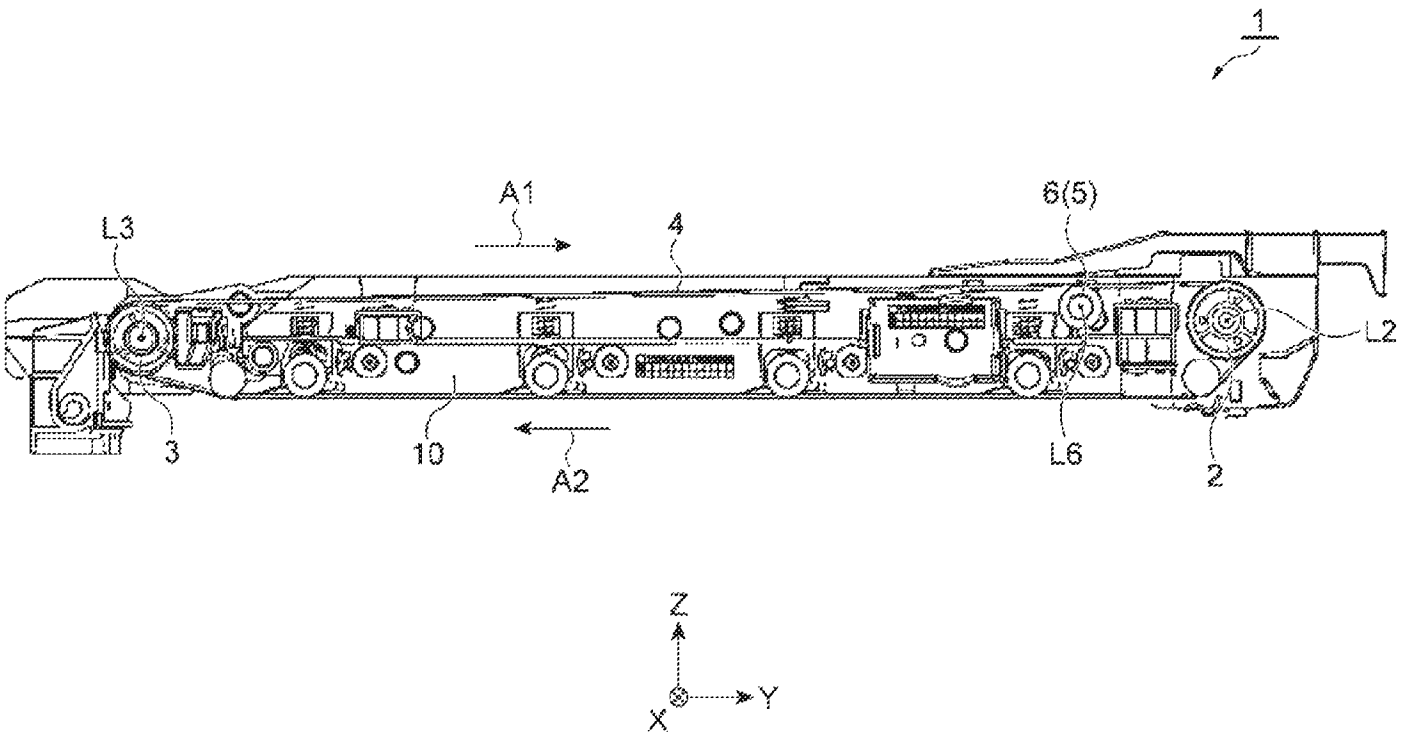

【Figure 3】
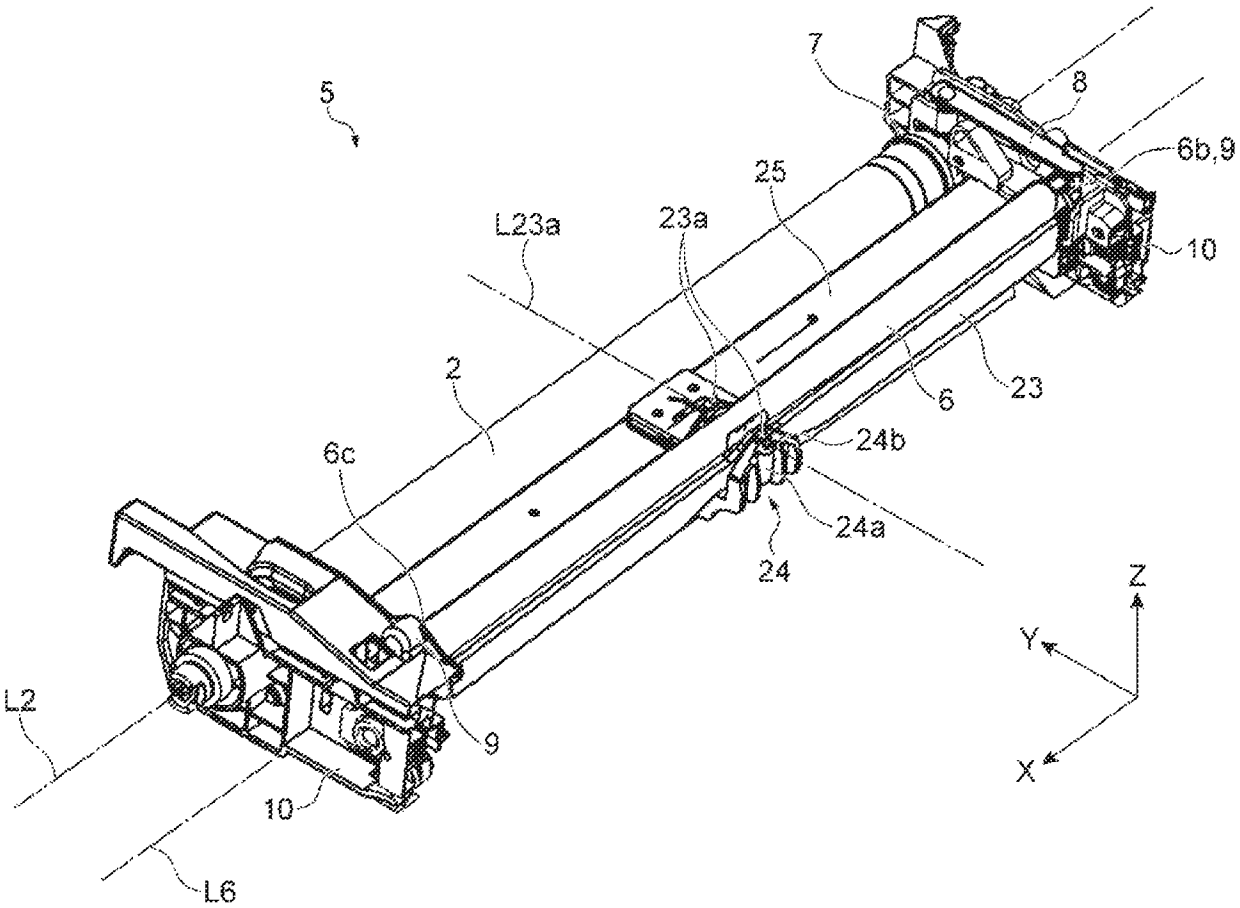

【Figure 4】
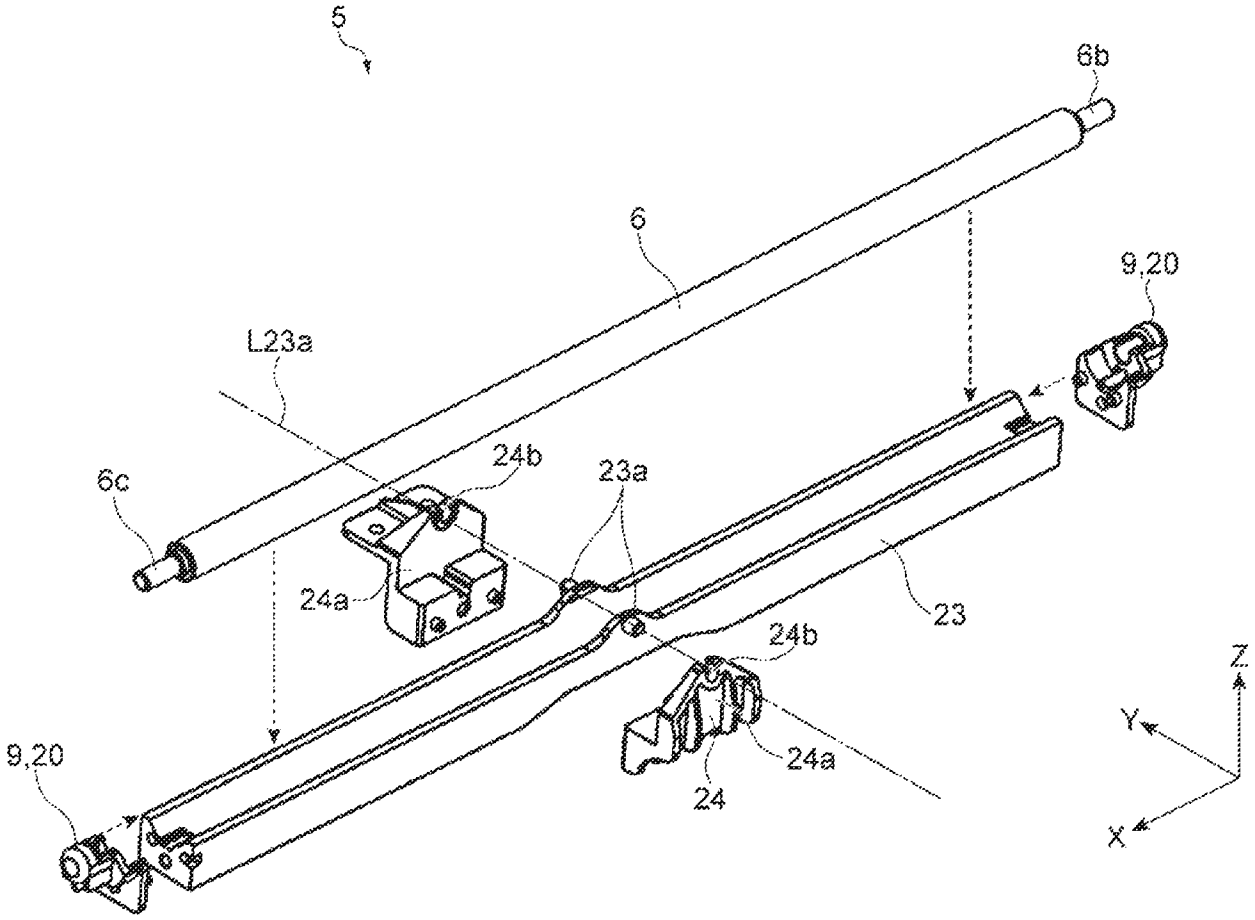

【Figure 5】
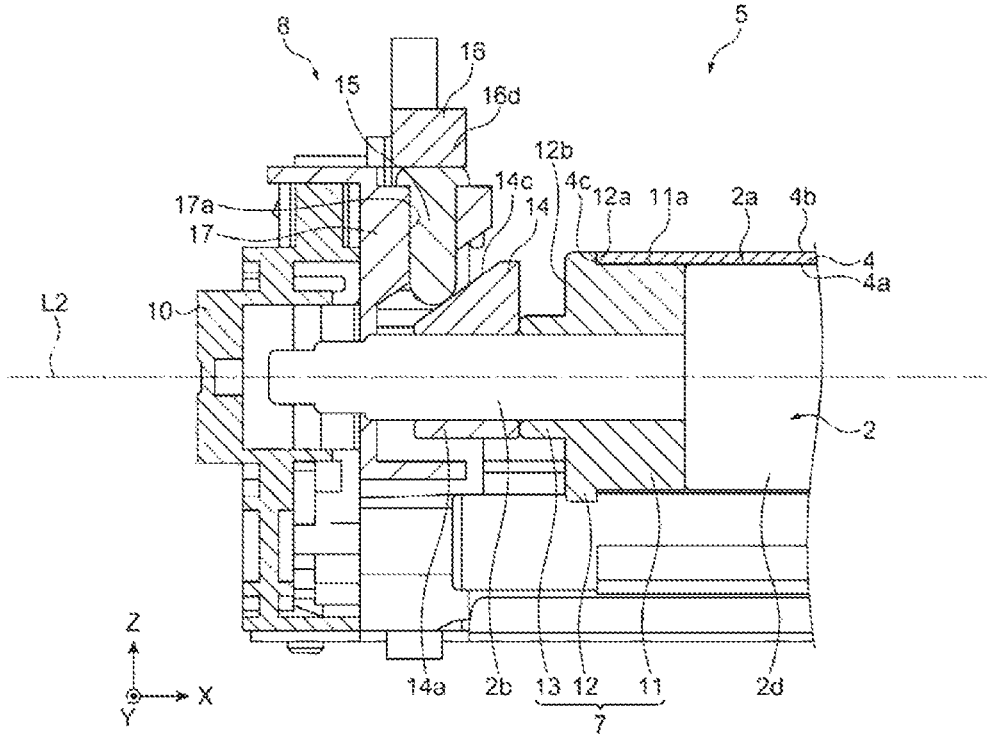
【Figure 6】
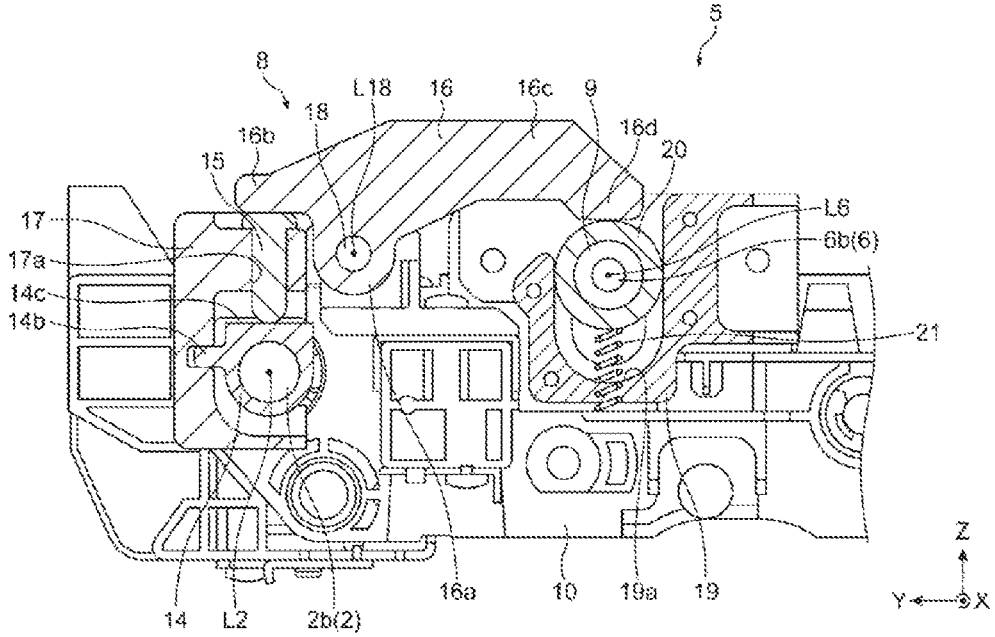

【Figure 7】
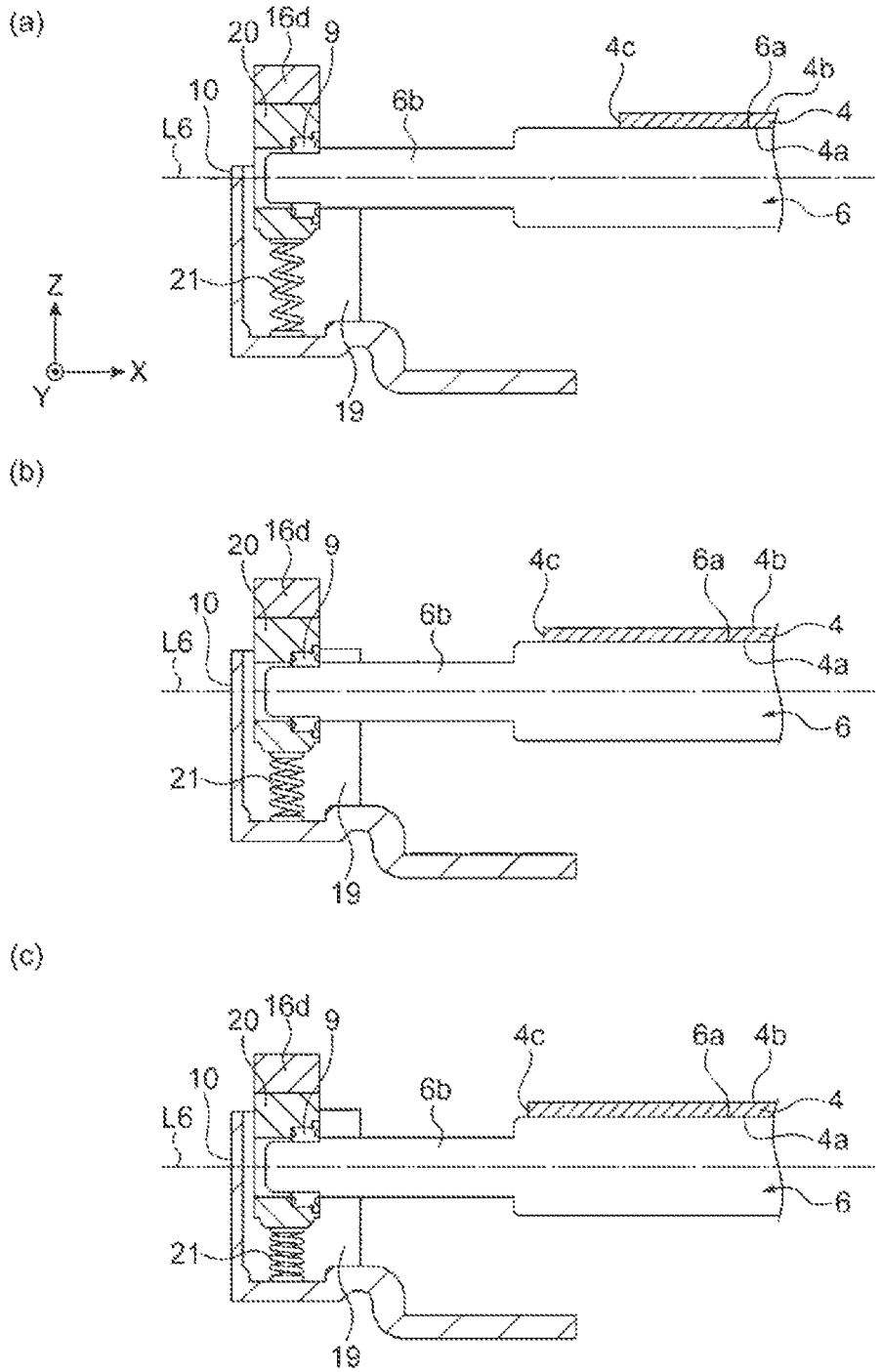

【Figure 8】
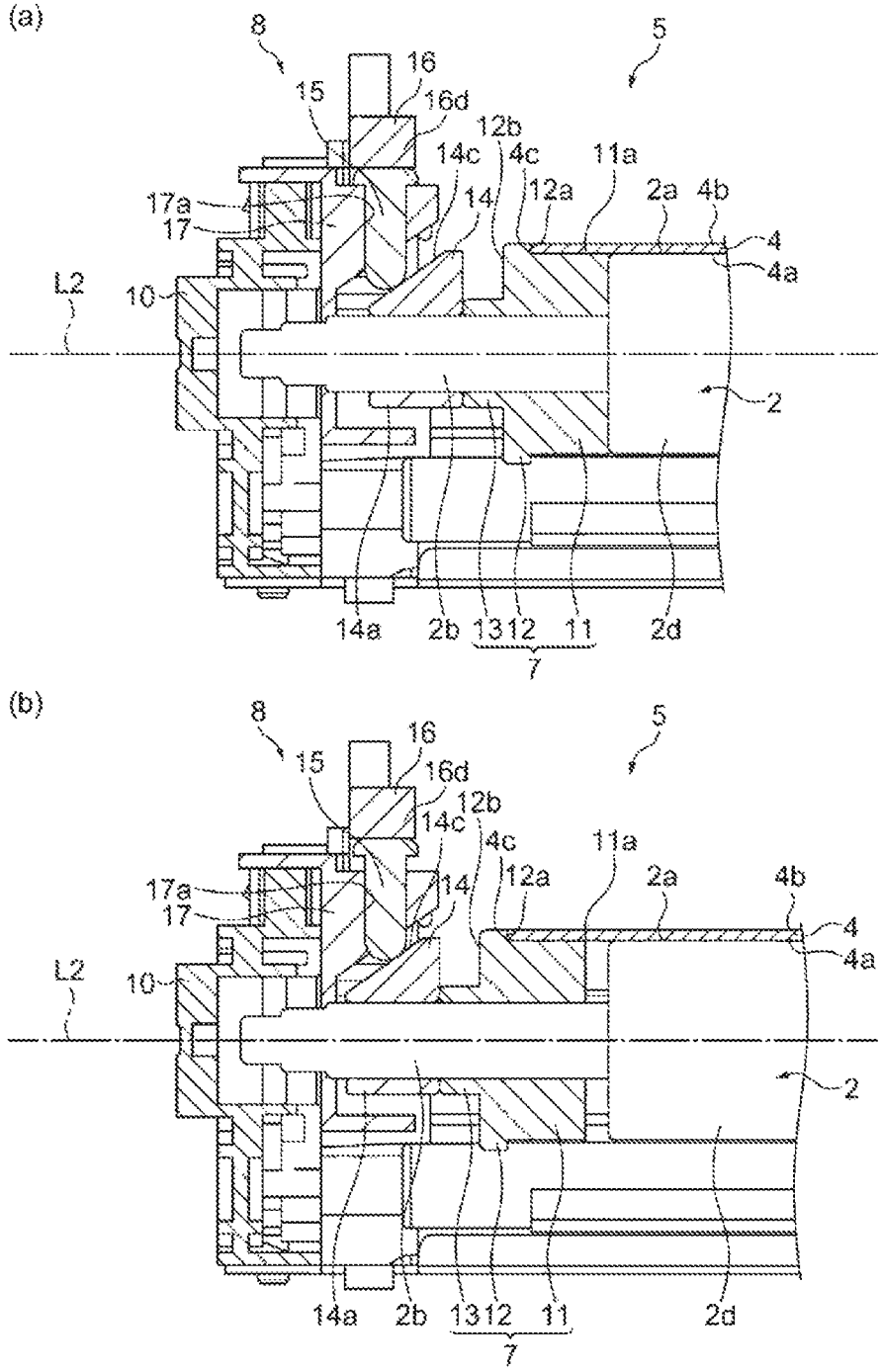

【Figure 9】
(a)
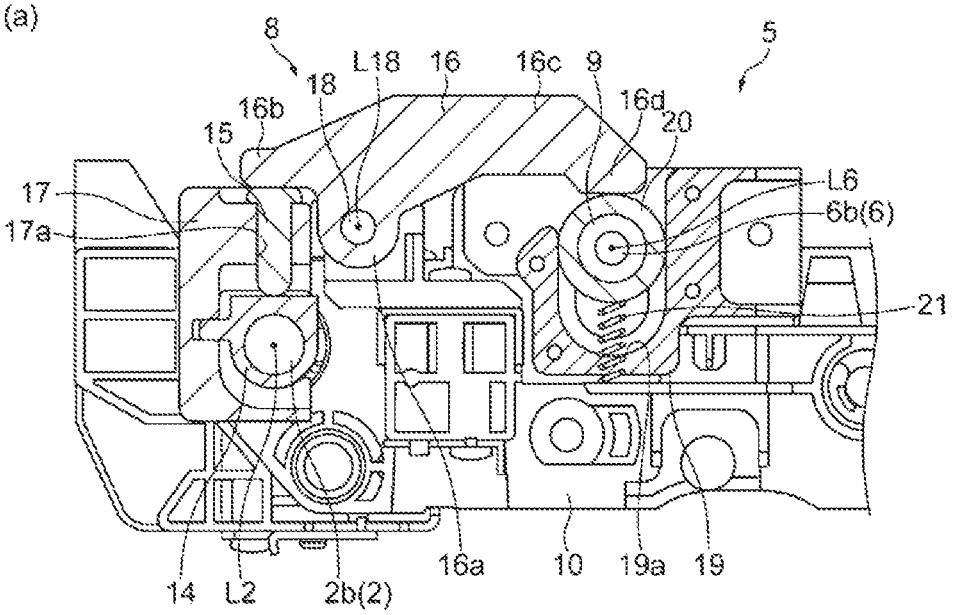
(b)
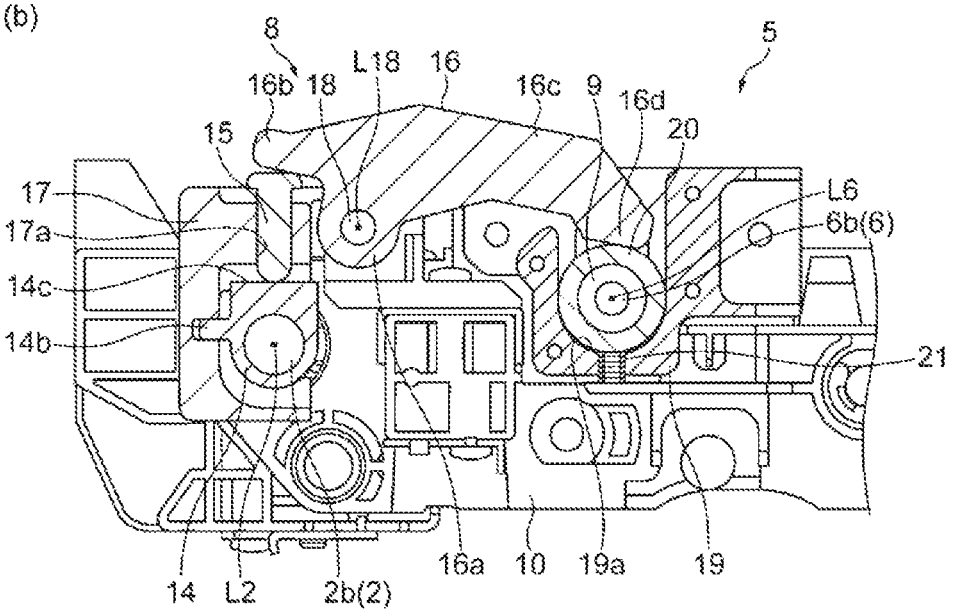

【Figure 10】
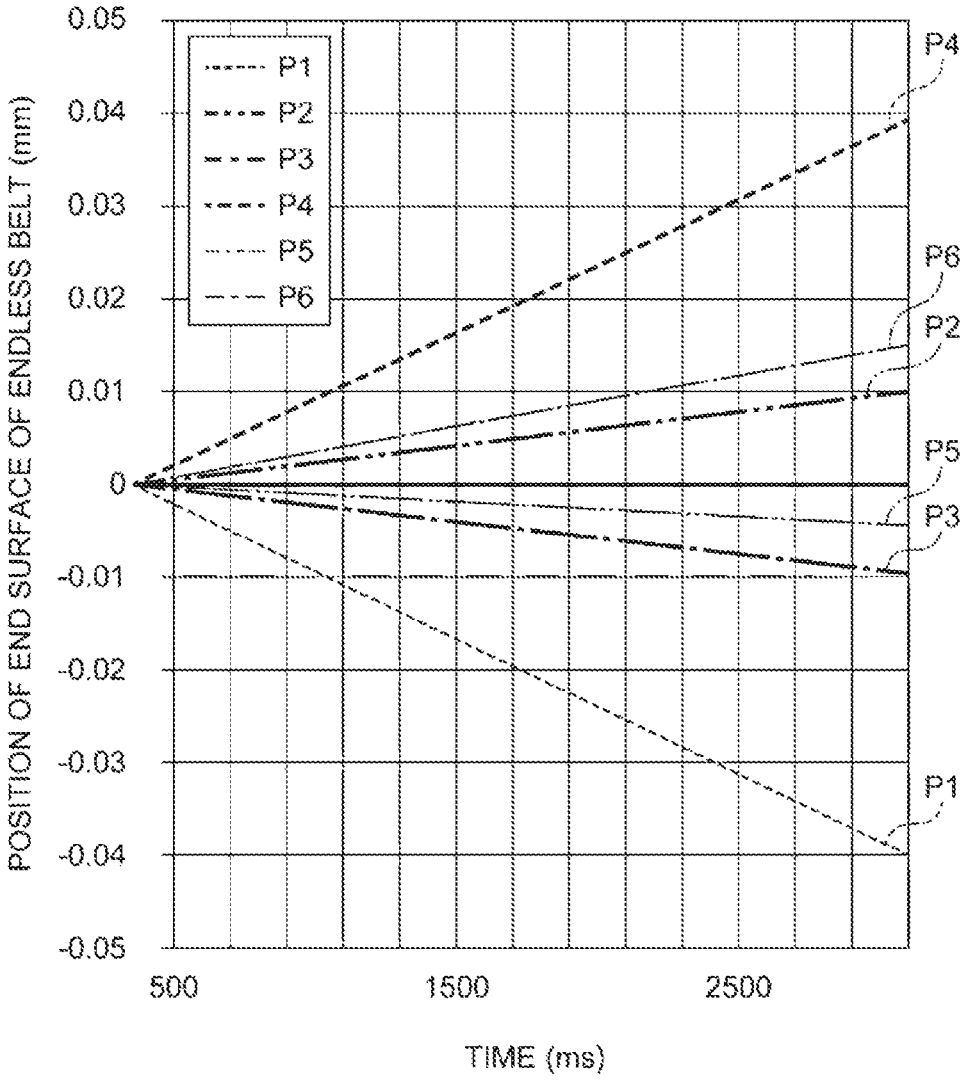

【Figure 11】
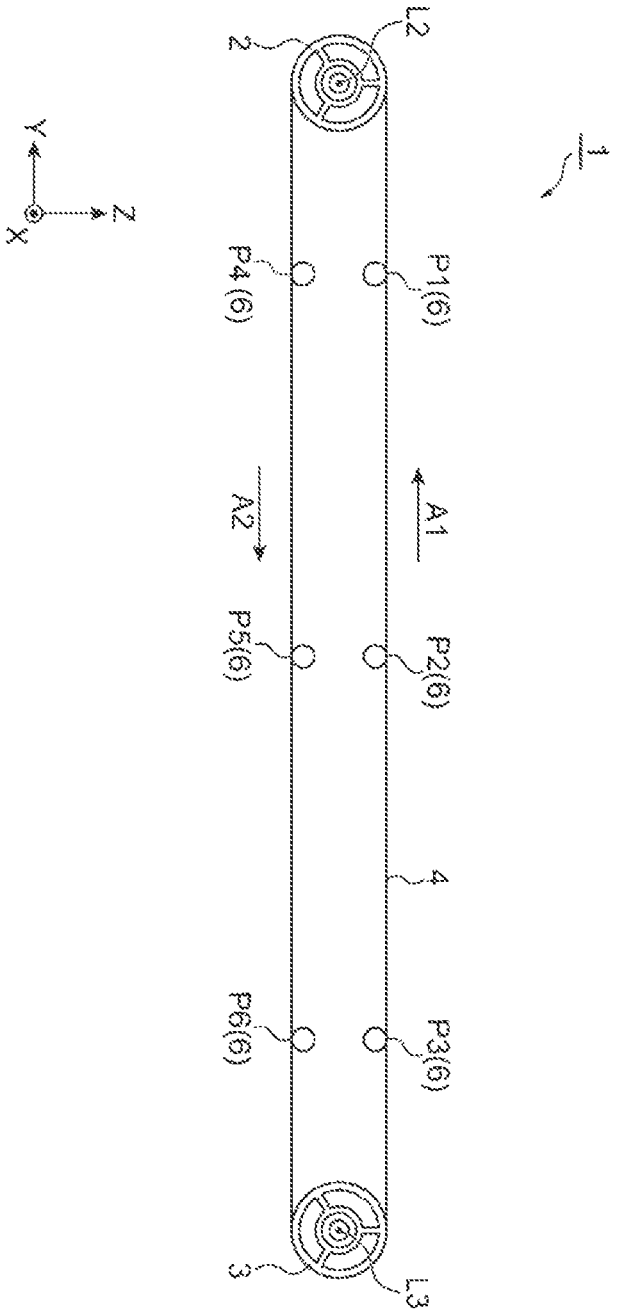

【Figure 12】
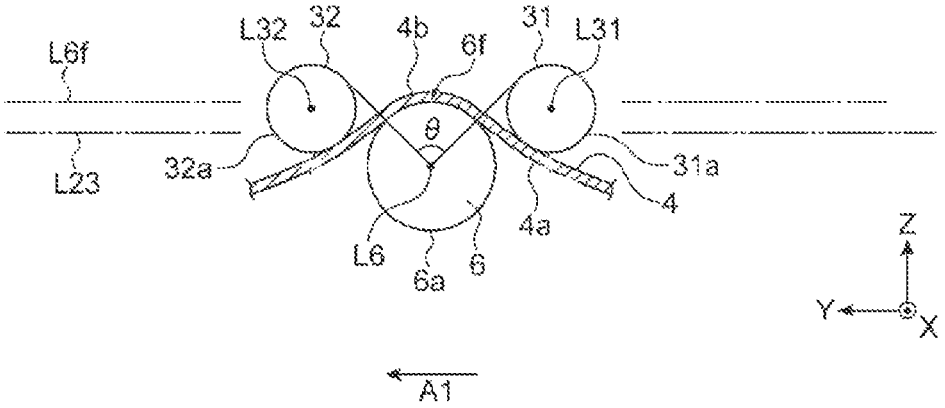
【Figure 13】
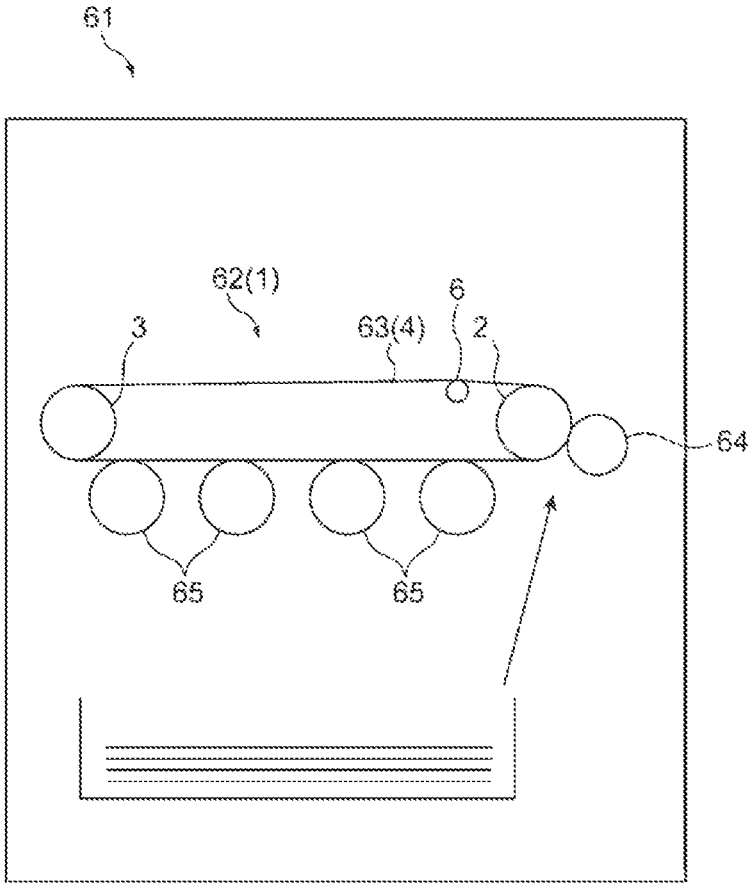

【Figure 14】
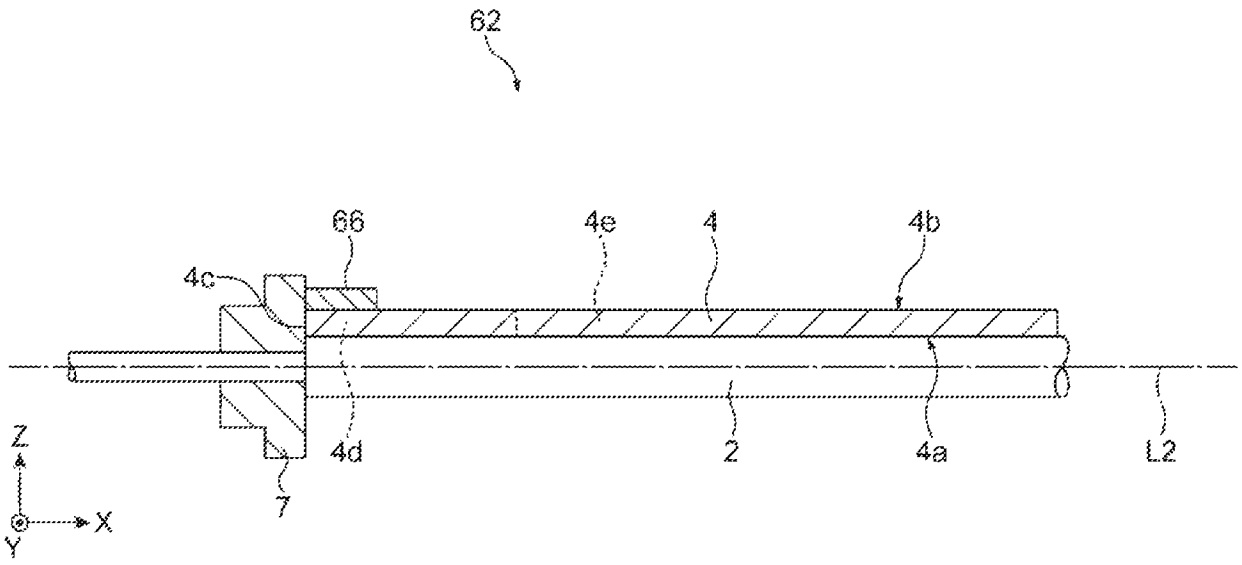

BELT DRIVING DEVICE WITH TILTABLE STEERING MEMBER

CROSS-REFERENCE TO RELATED APPLICATIONS

This application is a U.S. National Stage Application which claims the benefit under 35 U.S.C. § 371 of International Patent Application No. PCT/KR2018/011998 filed on Oct. 12, 2018, which claims foreign priority benefit under 35 U.S.C. § 119 of Japanese Patent Application No. 2017-211084 filed on Oct. 31, 2017, in the Japanese Intellectual Property Office, the contents of all of which are incorporated herein by reference

BACKGROUND ART

In an image forming apparatus, for example, an endless belt may be used as a conveyor belt for conveying a sheet or an intermediate transfer belt for secondarily transferring a toner. The endless belt is wound around a drive roller and a suspension roller (driven roller) and is driven along a circumferential orbit when power generated by the drive roller is transmitted thereto.

DESCRIPTION OF DRAWINGS

FIG. 1 is a perspective view of an example belt driving device.

FIG. 2 is a side view of the example belt driving device illustrated in FIG. 1.

FIG. 3 is a perspective view of an example belt position correction device of the belt driving device shown in FIG. 1.

FIG. 4 is an exploded perspective view of a steering roller, a bearing accommodation portion, a bearing support member, and a fixing tool of the belt position correction device shown in FIG. 3.

FIG. 5 is a cross-sectional view of an end portion structure of a drive roller, as viewed from a Y direction.

FIG. 6 is a cross-sectional view of the example belt position correction device, as viewed in an X direction.

FIGS. 7(*a*)-7(*c*) show cross-sectional views illustrating displacement positions of the example belt position correction device, at a first end portion of the steering roller.

FIGS. 8(*a*) and 8(*b*) show cross-sectional views illustrating displacement positions of the example belt position correction device, as viewed from the Y direction.

FIGS. 9(*a*) and 9(*b*) show cross-sectional views illustrating displacement positions of the example belt position correction device, as viewed from the X direction.

FIG. 10 is a graph showing a relationship between a position of the steering roller and a misalignment correction sensitivity of an endless belt.

FIG. 11 is a side view illustrating an example arrangement of an endless belt, a drive roller, a suspension roller, and a steering roller.

FIG. 12 is a diagram illustrating an example lap adjustment mechanism.

FIG. 13 is a schematic diagram illustrating an example color image forming apparatus including an intermediate transfer device.

FIG. 14 is a cross-sectional view of the drive roller, a wheel (or pulley), and the endless belt, in an example belt position correction device.

MODE FOR INVENTION

In the following description, with reference to the drawings, the same reference numbers are assigned to the same components or to similar components having the same function, and overlapping description is omitted.

In an image forming apparatus, a transfer belt may be provided with ribs on an inner circumferential surface (rear surface) of the transfer belt (endless belt). The ribs may be provided at the end portion of the transfer belt in the width direction and may protrude inwardly in the radial direction of a drive roller. When the transfer belt moves in the width direction, the ribs contact a detection roller so that the detection roller rotates. A transmission of the rotation of the detection roller causes a steering roller to tilt, in order to correct a rotation direction of the transfer belt.

If the ribs are depleted, the endless belt may shift onto the detection roller when the endless belt moves in the width direction, without engaging the detection roller, and thus there is possibility that the movement of the endless belt in the width direction may not be detected. Further, for an endless belt without any ribs, a movement of the endless belt in the width direction cannot be detected by the detection roller.

An example belt driving device includes a pair of belt rollers. The pair of belt rollers includes a first roller and a second roller, for example a drive roller which drives an endless belt and a suspension roller which rotates in a following manner with the movement of the endless belt while the endless belt is wound thereon. The drive roller and the suspension roller extend in a first direction and face each other in a second direction intersecting the first direction. The belt driving device includes a steering member which is located between the drive roller and the suspension roller. The steering member is tiltable while swinging about a rotation axis line passing through a center portion in the second direction (e.g. the steering member may be tiltable about a pivot having pivot axis). In some examples, the drive roller is the first roller, with the suspension roller being the second roller of the pair of belt rollers. In other examples, the suspension roller is the first roller, with the drive roller being the second roller of the pair of belt rollers.

The example belt driving device includes a wheel (or pulley), which may be inserted through an end portion of the first roller (e.g. drive roller). The wheel protrudes in a radial direction of the drive roller and is able to come into contact with an end surface of one end portion of the endless belt in the width direction. The wheel is movable outwardly along the first direction when the endless belt moves outwardly in the first direction. The wheel is pressed with the movement of the endless belt in the first direction and moves in the first direction. For example, the wheel may be biased by the endless belt, to move outwardly along the first direction with a movement of the endless belt in the first direction. The belt driving device includes a link mechanism. The link mechanism tilts the steering member by moving an end portion of the steering member with the outward movement of the wheel in the first direction.

When the endless belt moves in the width direction, an end surface of the endless belt contacts the wheel and the wheel moves outward in the first direction. Accordingly, the steering member is tilted by moving one end portion of the steering member by the displacement of the link mechanism. The tension of the endless belt at one end portion of the steering member is weakened as compared with the other end portion. As a result, the endless belt moves toward the other end portion in the width direction so that the misalignment of the endless belt is corrected.

Further, the steering member may be disposed between the drive roller (e.g. the first roller) and the suspension roller (e.g. the second roller) to be located on the side of the drive roller in relation to an intermediate point (e.g. a center point between the drive roller and the suspension roller). For example, the steering member may be located closer to the first roller than to the second roller. Also in such a configuration, it is possible to increase the movement speed of the endless belt in the width direction at the time of inclining the steering member. As a result, it is possible to promptly correct the misalignment of the endless belt.

The end portion of the first roller may correspond to a first end portion, and the first roller may include a second end portion opposite the first end portion. The wheel may correspond to a first wheel and the link mechanism may correspond to a first link mechanism. The belt driving device may further comprise a second wheel and a second link mechanism at the second end portion of the first roller. For example, the wheel may be provided at each of both end portions of the first roller (e.g. drive roller). The link mechanism may be provided at each of both sides in the first direction, so that the endless belt contacts the wheel when the endless belt moves in either direction along the first direction. Accordingly, it is possible to correct the misalignment by inclining the steering member and moving the endless belt in the width direction.

The link mechanism can tilt the steering member by moving the end portion of the steering member to be separated from the endless belt in a third direction. Additionally, the third direction is set to a direction intersecting the first direction and the second direction. A direction to be separated from the endless belt in the third direction may refer to a direction to be separated from a portion of the endless belt coming into contact with the steering member (e.g. a direction that moves the end portion away from the endless belt). For example, when the steering member is disposed below the endless belt (or disposed to contact the endless belt from below) on the assumption that the third direction is a vertical direction, the movement in the direction to be separated from the endless belt (the inward movement in the third direction) may indicate the downward movement.

When the wheel is not pressed by the endless belt, a contact position between the steering member and the endless belt may be deviated in a direction of pressing the endless belt from a position of the endless belt when the steering member does not exist in the third direction (e.g. when the steering member does not project in the third direction relative to a plane that extends along the steering member in a default position of the steering member when the wheel is not biased by the endless belt). When the wheel is not pressed by the endless belt, the contact position between the steering member and the endless belt may be deviated in a direction of pressing the endless belt by a maximum strain amount or more of the belt driving device from the position of the endless belt when the steering member does not project in the third direction. Also in such a configuration, it is possible to generate the tension suitable for the endless belt and to increase the friction between the endless belt and the steering member. The direction of pressing the endless belt in the third direction may refer to a direction of approaching the portion of the endless belt coming into contact with the steering member and may refer to a direction that is opposite to the direction of being separated from the endless belt. For example, when the steering member is disposed below the endless belt (e.g. the steering member is disposed to contact the endless belt from below) on the assumption that the third direction is the vertical direction, the "deviation in the direction of pressing the endless belt (the outward movement in the third direction)" indicates the upward deviation.

A contact length between the steering member and the endless belt in a circumferential direction of the steering member may be ¼ or more of a circumference of the steering member. Accordingly, it is possible to increase the friction between the endless belt and the steering member and to increase the tension applied to the endless belt.

The steering member may be a steering roller which rotates in a following manner with the movement of the endless belt. The belt driving device includes a pair of bearing portions which rotatably supports the steering roller. The belt driving device may include a bearing support member that extends in a longitudinal direction of the steering roller and supports a pair of bearings. The bearing support member swings along with the steering roller.

The endless belt may be a transfer belt for transferring a toner image. The transfer belt can be formed by a resin or elastic body. The end portion of the transfer belt in the width direction may be disposed outside an image forming area in the first direction and may be formed to be harder or thicker than the image forming area.

The end portion of the endless belt in the width direction may be subjected to a high hardness treatment. The end portion of the endless belt in the width direction may be subjected to a high hardness coating treatment as the high hardness treatment. A reinforcement member may be disposed at the end portion of the endless belt in the width direction.

With reference to FIG. 1 to 6 and FIG. 13, an example imaging system (belt driving device) 1, 61 may include a pair of belt rollers 2, 3, a steering roller 6, a wheel 7, and a link mechanism 8. The pair of belt rollers 2, 3 includes a first roller (e.g. a drive roller 2) and a second roller (e.g. a suspension roller 3) to drive an endless belt 4 along a belt path. The steering roller 6 is located between the first roller 2 and the second roller 3 to engage the endless belt 4, and the steering roller 6 is tiltable. The wheel 7 is located at an end of the first roller 2 in abutment with an edge of the endless belt 4, and the wheel 7 is movable along a rotation axis line L2 of the first roller 2, in an outward direction, when the endless belt 4 shifts away from the belt path toward the wheel 7. The link mechanism 8 is coupled between the wheel 7 and the steering roller 6 to tilt the steering roller 6 in response to a sliding movement of the wheel 7 in the outward direction, in order to urge the endless belt 4 to shift toward the belt path. The imaging system may comprise an image forming apparatus 61 such as a printer or the like, or a portion thereof, such as a belt driving device 1 for example. In some examples, the first roller is the drive roller 2, with the second roller being the suspension roller 3. In other examples, the first roller is the suspension roller 3, with the second roller being the drive roller 3.

The link mechanism 8 may include a shift member (first intermediate member) 14 coupled with the wheel 7 about an end 2*b* of the first roller 2, a pivot arm (or second intermediate member) 16 coupled between the shift member 14 and the steering roller 6, and a pin (or pin member) 15 coupled between the shift member 14 and the pivot arm 16. The shift member 14 may be urged by the wheel 7 in the outward direction. The shift member 14 has a first end and a second end, where the second end is positioned between the first end and the endless belt 4. The shift member 14 has an inclined surface 14*c* extending between the first end and the second end, and a distance between the inclined surface 14*c* and the first end portion 2*b* of the first roller 2 increases from the first end to the second end. The pivot arm 16 has a first end (of accommodation portion) 16*b* and a second end (or pressing portion) 16*d* opposite the first end relative to a pivot axis L18 of the pivot arm 16. The first end 16*b* is coupled with the inclined surface 14*c* of the shift member 14, via the pin 15. The first end 16*b* is urged away from the first roller 2, along the inclined surface 14*c* (e.g. in parallel with the inclined surface 14*c*) when the shift member 14 is moved in the outward direction. The second end 16*d* is coupled with an end of the steering roller 6, to pivot about the pivot axis L18 of the pivot arm 16, when the first end 16*b* is moved away from the first roller 2, in order to urge the steering roller 6 to tilt away from the endless belt 4.

Further, an example image forming apparatus may include the example belt driving device. In the example image forming apparatus, a misalignment of the endless belt in the width direction is corrected. Accordingly, it is possible to improve the generated image quality.

According to the example belt driving device and the example image forming apparatus, it is possible to correct a misalignment by reliably detecting a movement of an endless belt in a width direction even in an endless belt without ribs.

An example belt driving device 1 illustrated in FIGS. 1 and 2 includes a drive roller 2, a suspension roller 3, and an endless belt 4. The drive roller 2 and the suspension roller 3 extend in an X direction (first direction) and are disposed to face each other in a Y direction (second direction) intersecting the X direction. Additionally, a direction intersecting the X direction and the Y direction will be referred to as a Z direction (third direction). Power is transmitted from an electric motor (not illustrated) to the drive roller 2 so that the drive roller 2 rotates about a rotation axis line L2 extending in the X direction. The endless belt 4 is wound on the drive roller 2 and the suspension roller 3 and moves along a circumferential orbit with the rotation of the drive roller 2. The suspension roller 3 rotates about a rotation axis line L3 with the movement of the endless belt 4. A bearing which supports the drive roller 2 and a bearing which supports the suspension roller 3 are supported by frames 10 located on both sides in the X direction and extending in the Y direction.

The belt driving device 1 may be used as a transfer unit which secondarily transfers a toner image developed by a developing unit to a sheet, for example, in an image forming apparatus such as a printer. The endless belt 4 also serves as an intermediate transfer belt in the transfer unit. Further, the belt driving device 1 may be used as a sheet conveying unit which conveys a sheet. The endless belt 4 serves as a sheet conveyor belt in the sheet conveying unit.

The belt driving device 1 includes a belt position correction device 5 which corrects the movement of the endless belt 4 in the width direction (the X direction). The belt position correction device 5 includes a steering roller (steering member) 6, a wheel (or pulley) 7, and a link mechanism 8. Additionally, the wheel 7 and the link mechanism 8 are not illustrated in FIG. 2.

The steering roller 6 is disposed between the drive roller 2 and the suspension roller 3 in the Y direction. The steering roller 6 is disposed on an upstream side of the drive roller 2 and a downstream side of the suspension roller 3 in a circumferential movement direction A1 of the endless belt 4. The steering roller 6 is disposed at the upper side of the circumferential orbit of the endless belt 4 to come into contact with an inner circumferential surface 4*a* of the endless belt 4 moving from the suspension roller 3 toward the drive roller 2. The steering roller 6 is disposed on the side of the drive roller 2 in relation to an intermediate point between the drive roller 2 and the suspension roller 3 in the Y direction and is disposed near the drive roller 2 in relation to the suspension roller 3.

An outer circumferential surface 6*a* (See FIG. 7) of the steering roller 6 comes into contact with the inner circumferential surface 4*a* of the endless belt 4. The steering roller 6 rotates in a following manner about an axis line L6 with the circumferential movement of the endless belt 4. As illustrated in FIGS. 3 and 4, both end portions (a first end portion 6*b* and a second end portion 6*c*) of the steering roller 6 are rotatably supported by a bearing (bearing member) 9.

Further, the belt position correction device 5 includes a bearing support member 23 and a fixing tool 24. The bearing support member 23 extends in the longitudinal direction of the steering roller 6. A bearing accommodation portion 20 is connected to both end portions of the bearing support member 23 in the longitudinal direction. The bearing accommodation portion 20 accommodates the bearing 9. The bearing support member 23 is formed to cover, for example, a lower portion in the outer circumferential surface 6*a* of the steering roller 6. A support point portion 23*a* is formed at the center portion of the bearing support member 23 in the longitudinal direction. The support point portion 23*a* is formed in a columnar shape and protrudes outward in the Y direction.

The fixing tool 24 supports the bearing support member 23 in a swingable manner. The fixing tool 24 includes a pair of clamping portions 24*a* and 24*a* which supports the bearing support member 23 from both sides in the Y direction. The pair of clamping portions 24*a* is connected at the lower portion of the bearing support member 23. Further, the clamping portion 24*a* is provided with a bearing 24*b* which supports the support point portion 23*a* in a rotatable manner. The bearing 24*b* includes a sliding surface which comes into contact with the outer circumferential surface of the support point portion 23*a*. Further, the fixing tool 24 is fixed to, for example, a connection member 25. The connection member 25 extends in the X direction and connects the pair of frames 10 facing each other in the X direction. The fixing tool 24 is fixed to the frame 10 through the connection member 25. The steering roller 6 is supported by the bearing support member 23 and is swingable along with the bearing support member 23. The steering roller 6 is swingable about an axis line L23*a* extending in the Y direction. The first end portion 6*b* and the second end portion 6*c* of the steering roller 6 are displaceable in the Z direction (third direction). The steering roller 6 is tiltable using the support point portion 23*a* as a support point while the first end portion 6*b* is pressed. In the belt position correction device 5, the wheel 7 and the link mechanism 8 are provided at the first end portion 6*b* of the steering roller 6. In some examples, the belt position correction device 5 may be located at the first end 6*b* of the steering roller 6, without any similar belt position correction device 5 at the second end portion 6*c* of the steering roller 6.

As illustrated in FIGS. 5 and 6, the wheel 7 is inserted through a first end portion 2*b* of the drive roller 2. The wheel 7 includes a cylindrical portion 11, a flange portion 12, and a small diameter portion 13. The wheel 7 is slidable in the extension direction of the drive roller 2. The outer diameter of the first end portion 2*b* of the drive roller 2 is smaller than the outer diameter of a main body portion 2*d* of the drive roller 2. The length of the main body portion 2*d* of the drive roller 2 in the X direction is slightly shorter than the width of the endless belt 4 (the length in the X direction). The outer diameter of the cylindrical portion 11 is substantially the same as the outer diameter of the main body portion 2*d* of the drive roller 2. An outer circumferential surface 11*a* of the cylindrical portion 11 and an outer circumferential surface 2*a* of the main body portion 2*d* of the drive roller 2 are disposed at the substantially same position from the axis line L2 in the radial direction of the drive roller 2. The outer circumferential surface 11*a* of the cylindrical portion 11 is able to come into contact with the inner circumferential surface 4*a* of the endless belt 4.

The flange portion 12 is formed in the entire circumference and protrudes outward in relation to the outer circumferential surface 11*a* of the cylindrical portion 11 in the radial direction. The flange portion 12 protrudes to the outside in relation to the outer circumferential surface 4*b* of the endless belt 4 in the radial direction. An inner surface 12*a* of the flange portion 12 faces an end surface 4*c* of the endless belt 4 in the X direction and is able to come into contact therewith. The inner surface 12*a* of the flange portion 12 is a surface facing the inside in the extension direction of the axis line L6 of the steering roller 6 and is a surface on the side of the endless belt 4. An outer surface 12*b* of the flange portion 12 is a surface facing the outside in the extension direction of the axis line L6 and is a surface on the side of the bearing. The small diameter portion 13 is a cylindrical portion having a diameter smaller than that of the cylindrical portion 11 and protrudes outward in the X direction.

The link mechanism 8 includes a first intermediate member 14, a pin member 15, and a second intermediate member 16. The first intermediate member 14 is inserted through the first end portion 2*b* of the drive roller 2 at the outside in relation to the wheel 7 in the X direction. The first intermediate member 14 moves outward in the X direction with the movement of the wheel 7. For example, the first intermediate member 14 may be located at the end portion 2*b* of the first roller 2, whereby the wheel 7 is located between the first intermediate member 14 and the endless belt 4 in the first direction X, and the first intermediate member 14 is moveable outwardly in the first direction X with a movement of the wheel 7. The first intermediate member 14 includes a main body portion 14*a* provided with an opening portion and inserted through the first end portion 2*b*. A side portion of the main body portion 14*a* is provided with an overhanging piece 14*b* which protrudes outward in the Y direction. The overhanging piece 14*b* is formed in, for example, a plate shape and extends in the X direction. A plate thickness direction of the overhanging piece 14*b* is a direction along the Z direction. An upper surface of the main body portion 14*a* is formed as an inclined surface 14*c*. The inclined surface 14*c* is tilted to be separated from the axis line L2 as it moves from the outside (e.g. an outer side of the first intermediate member 14) toward the inside (e.g. an inner side of the first intermediate member 14) in the X direction. For example, the inner side is positioned between the endless belt 4 and the outer side of the first intermediate member 14, such that the outer side is further away from the endless belt 4 relative to the inner side. The inclined surface 14*c* may be inclined so as to be closer to the drive roller 2 toward the outer side than toward the inner side of the first intermediate member 14. For example, the inclined surface 14*c* is formed to be higher (e.g. increase in width) from the outside (outer side) toward the inside (inner side) in the X direction. Accordingly, when the first intermediate member 14 moves outward in the X direction, a member (e.g. pin member 15) contacting the inclined surface 14*c* can be pressed upward (e.g. away from the drive roller 2 or the axis line L2).

The pin member 15 is formed in a columnar shape and extends in the Z direction. The pin member 15 is held by a holding member 17 fixed to the frame 10. The holding member 17 is provided with an opening portion 17*a* extending in the Z direction. The pin member 15 is inserted through the opening portion 17*a* to be held therein. A lower end portion of the pin member 15 is formed as, for example, a spherical surface. The lower end portion of the pin member 15 protrudes downward from the opening portion 17*a* and comes into contact with the inclined surface 14*c* of the first intermediate member 14. The pin member 15 is held by the holding member 17 and is movable in the Z direction. Further, an upper end portion of the pin member 15 is provided with a flange portion which protrudes in the radial direction of the pin member 15. The flange portion comes into contact with a circumferential edge portion of the opening portion 17*a* so as to prevent the pin member 15 from being dropped.

The second intermediate member 16 includes a support point portion 16*a*, an accommodation portion 16*b*, a continuous portion 16*c*, and a pressing portion 16*d*. The support point portion (the pivot portion) 16*a* is supported by a support shaft 18 fixed to the frame 10. The support shaft 18 is disposed between the drive roller 2 and the steering roller 6 in the Y direction and extends in the X direction. The support shaft 18 protrudes inward in the X direction from the frame 10. The support point portion 16*a* is provided with an opening portion through which the support shaft 18 is inserted and the support shaft 18 is inserted through the opening portion. The support point portion 16*a* is rotatable about the support shaft 18. An axis line L18 of the support shaft 18 is disposed above, for example, the axis lines L2 and L6 in the Z direction.

The accommodation portion 16*b* is connected to the support point portion 16*a* and protrudes outward in the Y direction. The accommodation portion 16*b* is disposed at the upper side in relation to the support point portion 16*a*. The accommodation portion 16*b* extends to a position in which the accommodation portion 16*b* is able to come into contact with the upper end portion of the pin member 15. The accommodation portion 16*b* comes into contact with the upper end portion of the pin member 15. The accommodation portion 16*b* is displaced with the movement of the pin member 15 in the Z direction. When the pin member 15 moves upward, the accommodation portion 16*b* moves upward with the upward movement.

The continuous portion 16*c* is connected to the support point portion 16*a* and extends inward in the Y direction. The continuous portion 16*c* extends to the opposite side to the accommodation portion 16*b* in the Y direction. The continuous portion 16*c* is disposed at the upper side in relation to the support point portion 16*a*. The continuous portion 16*c* extends to the upper side of the first end portion 6*b* of the steering roller 6. The continuous portion 16*c* swings in accordance with the rotation of the support point portion 16*a*. The pressing portion 16*d* is provided at a front end of the continuous portion 16*c*. The pressing portion 16*d* includes a surface which comes into contact with the outer circumferential surface of the bearing accommodation portion 20 accommodating the bearing 9. When the continuous portion 16*c* swings, the pressing portion 16*d* moves downward to press the bearing accommodation portion 20 and press the bearing 9 and the first end portion 6*b* of the steering roller 6 downward.

As illustrated in FIGS. 6 and 7(*a*)-7(*c*), the bearing accommodation portion 20 which accommodates the bearing 9 supporting the first end portion 6*b* is supported by a spring member 21 in the frame 10. The spring member 21 extends in the Z direction and supports the bearing accommodation portion 20 from below. A lower end portion of the spring member 21 is supported by a connection tool 19 fixed to the frame 10. The upper end portion of the spring member 21 is connected to the bearing accommodation portion 20. The spring member 21 is lengthened and shortened in the Z direction and urges the bearing accommodation portion 20 upward.

The connection tool 19 is provided with an accommodation portion 19*a* which holds the bearing accommodation portion 20. The accommodation portion 19*a* is a concave portion which is recessed downward and a facing wall surface of the concave portion in the Y direction comes into contact with the bearing accommodation portion 20 to restrict the movement direction of the bearing accommodation portion 20. Further, a bottom surface of the concave portion is able to come into contact with the lower surface of the bearing accommodation portion 20 and is able to restrict the downward movement range of the bearing accommodation portion 20.

Next, an example operation of the belt driving device 1 will be described. Power is transmitted to the endless belt 4 by the drive roller 2 so that the endless belt 4 circumferentially moves. The suspension roller 3 rotates with the movement of the endless belt 4. Further, the steering roller 6 rotates with the movement of the endless belt 4.

As illustrated in FIG. 8(*a*) and FIG. 8(*b*), when the endless belt 4 is displaced to the outside in the width direction toward the first end portion 2*b*, the end surface 4*c* of the endless belt 4 comes into contact with the inner surface 12*a* of the flange portion 12 of the wheel 7. When the movement amount of the endless belt 4 in the width direction increases, the endless belt 4 presses the wheel 7. When the wheel 7 moves to the outside from the state illustrated in FIGS. 8(*a*) and 9(*a*), the pin member 15 is pressed upward by the inclined surface 14*c* as illustrated in FIGS. 8(*b*) and 9(*b*). When the pin member 15 is displaced upward, the accommodation portion 16*b* of the second intermediate member 16 is pressed upward and the second intermediate member 16 swings about the axis line L18.

Accordingly, the pressing portion 16*d* is displaced downward to press the bearing accommodation portion 20 downward. As illustrated in FIGS. 7(*a*)-7(*c*), the first end portion 6*b* of the steering roller 6 moves downward so that the steering roller 6 is tilted.

When the steering roller 6 is tilted, the tension of the endless belt 4 becomes weak at the first end portion 6*b* compared to the second end portion 6*c*. As a result, the endless belt 4 moves toward the second end portion 6*c* in the width direction so that the misalignment of the endless belt 4 is corrected. When the endless belt 4 moves toward the second end portion 6*c*, a force in which the endless belt 4 presses the wheel 7 outward in the X direction becomes weak. In accordance with this movement, since the spring member 21 urges the bearing accommodation portion 20 upward, the bearing 9 and the first end portion 6*b* move upward and the pressing portion 16*d* of the second intermediate member 16 moves upward. In accordance with this movement, the accommodation portion 16*b* moves downward so that the pin member 15 is pressed downward. When the pin member 15 coming into contact with the inclined surface 14*c* moves downward, the first intermediate member 14 moves inward in the X direction. The wheel 7 is pressed back by the first intermediate member 14 to return to an original position as illustrated in FIG. 8(*a*).

According to the example belt driving device 1, when the endless belt 4 is without ribs, the end surface 4*c* of the endless belt 4 is brought into contact with the wheel 7 and the second intermediate member 16 is driven to tilt the steering roller 6 by the movement of the first intermediate member 14 and the pin member 15. The steering roller 6 swings about the center portion in the longitudinal direction as a support point. As a result, the movement of the endless belt 4 in the width direction can be corrected.

According to the example belt driving device 1, since the misalignment of the endless belt 4 in the width direction is corrected, a meandering of the endless belt 4 can be suppressed. Further, a deformation (undulation) of the endless belt 4 due to a variation in tension of the endless belt 4 can be suppressed. In the intermediate transfer device including the belt driving device 1, the uniformity of an image transferred onto the endless belt 4 can be secured.

Next, a relationship between the arrangement position of the steering roller 6 and the movement speed of the endless belt 4 in the width direction will be described with reference to FIG. 10. In FIG. 10, a horizontal axis indicates a time [ms] and a vertical axis indicates a position of the end surface 4*c* of the endless belt 4. The position of the end surface 4*c* is the position of the endless belt 4 in the width direction and is the position in the extension direction of the axis line L6. Additionally, in this arrangement, the inclination angle of the steering roller 6 is the same.

With reference to FIG. 11, a change in position of the endless belt 4 in the width direction is measured while arrangement positions P1 to P6 of the steering rollers 6 are changed. The arrangement positions P1 to P3 are located on the upstream side of the drive roller 2 and the downstream side of the suspension roller 3. At the arrangement positions P1 to P3, the endless belt 4 moves along the circumferential movement direction A1 from the suspension roller 3 toward the drive roller 2 (tension side). The arrangement positions P4 to P6 are located on the downstream side of the drive roller 2 and the upstream side of the suspension roller 3. At the arrangement positions P4 to P6, the endless belt 4 moves along a circumferential movement direction A2 from the drive roller 2 toward the suspension roller 3 (loose side). Further, the arrangement positions P1 and P4 are located in the vicinity of the drive roller 2 and the arrangement positions P3 and P6 are located in the vicinity of the suspension roller 3. The arrangement positions P2 and P5 are intermediate positions between the drive roller 2 and the suspension roller 3 in the Y direction.

As shown in FIG. 10, as the inclination of the graph increases, the movement amount of the endless belt 4 in the width direction increases and the correction sensitivity (response performance) increases. Accordingly, a misalignment of the endless belt 4 in the width direction may be corrected more effectively as the inclination of the graph increases. Since the inclination of the graph (P1, P4) is larger as the steering roller 6 is closer to the drive roller 2, the misalignment of the endless belt 4 in the width direction may be corrected more effectively.

In some examples, the belt driving device 1 includes lap amount adjustment rollers (lap amount adjustment mechanisms) 31 and 32, as illustrated in FIG. 12.

The lap amount adjustment rollers 31 and 32 are disposed on the upstream side and the downstream side of the steering roller 6 in the circumferential movement direction A1 of the endless belt 4. The lap amount adjustment roller 31 is located on the upstream side of the steering roller 6 and the lap amount adjustment roller 32 is located on the downstream side of the steering roller 6. The bottom points of the outer circumferential surfaces 31*a* and 32*a* of the lap amount adjustment rollers 31 and 32 are located below the top points of the outer circumferential surfaces 6*a* of the steering rollers 6.

The lap amount adjustment rollers 31 and 32 are supported by the frame 10 on the side of the first end portion 6*b* of the steering roller 6. The lap amount adjustment rollers 31 and 32 are rotatable about axis lines L31 and L32 extending in the X direction. The lap amount adjustment rollers 31 and 32 come into contact with the outer circumferential surface 4*b* of the endless belt 4 and rotate in a following manner in accordance with the circumferential movement of the endless belt 4. As illustrated in FIG. 12, the lap amount adjustment rollers 31 and 32 are provided in the vicinity of the first end portion 6*b* of the steering roller 6 in the X direction. In some example belt driving devices, lap amount adjustment rollers 31 and 32 are located toward the first end portion 6*b* of the steering roller 6, without any similar lap amount adjustment rollers at the second end portion 6*c* of the steering roller 6. The lap amount adjustment rollers 31 and 32 press the endless belt 4 downward to increase a contact area between the steering roller 6 and the endless belt 4. A contact length between the outer circumferential surface 6*a* of the steering roller 6 and the inner circumferential surface 4*a* of the endless belt 4 in the circumferential direction of the steering roller 6 becomes ¼ or more of the circumference of the steering roller 6. For example, the outer circumferential surface 6*a* of the steering roller 6 may contact the endless belt 4 by 90° or more in the rotation angle θ of the steering roller 6.

Accordingly, it is possible to increase the tension applied to the endless belt 4 by pressing the endless belt 4 against the steering roller 6, by means of the lap amount adjustment rollers 31 and 32.

In another example belt driving device 1, the first end portion 6*b* of the steering roller 6 applies a strain equal to or larger than the maximum strain amount of the belt driving device 1 to the endless belt 4 in a condition that the belt driving device 1 is installed in the initial state. Additionally, the initial state indicates a state in which the wheel 7 is not pressed by the end surface 4*c* of the endless belt 4 and the misalignment of the endless belt 4 in the width direction does not occur as illustrated in FIG. 5.

In the example belt driving device 1, a contact position L6*f* between the steering roller 6 and the endless belt 4 is deviated to the outside by a maximum strain amount or more of the belt driving device 1 from a position L23 of the endless belt 4 when the steering roller 6 does not exist (or project) in the Z direction as illustrated in FIG. 12 in the initial state. The contact position L6*f* between the steering roller 6 and the endless belt 4 indicates the highest position in an area in which the steering roller 6 contacts the endless belt 4 and is, for example, a top point 6*f* of the outer circumferential surface 6*a* of the steering roller 6. Further, the position L23 of the endless belt 4 when the steering roller 6 does not project is, for example, the position of the tangent line which is in contact with the upper portion of the outer circumferential surface of the drive roller 2 and the upper portion of the outer circumferential surface of the suspension roller 3. Further, the maximum strain amount or more of the belt driving device 1 is, for example, the maximum strain amount or more when the belt driving device 1 is installed in a use environment and can be set to be equal to or larger than a difference in height between both end portions of the drive roller 2. For example, the first end portion 6*b* of the steering roller 6 is disposed at a slightly high position compared to the second end portion 6*c* in the initial state. Further, the maximum movement amount of the end portion of the steering roller 6 in the Z direction may be equal to or larger than the maximum strain amount of the belt driving device 1.

Since the tension of the first end portion 6*b* of the steering roller 6 with respect to the endless belt 4 is higher than that of the second end portion 6*c* in the initial state, the endless belt 4 is easily deviated to the first end portion 6*b* in relation to the second end portion 6*c*. Accordingly, when the endless belt 4 moves to the first end portion 6*b*, the bearing support member 23 is made to swing so that the first end portion 6*b* is pressed downward and the tilting degree of the steering roller 6 is changed. In this way, the endless belt 4 can be returned to the second end portion 6*c*. Accordingly, it is possible to correct the misalignment of the endless belt 4 in the width direction. Additionally, the first end portion 6*b* of the steering roller 6 may apply a strain equal to or larger than the maximum strain amount of the belt driving device 1 in a condition that the belt driving device 1 is installed in the initial state to the endless belt 4.

In another example belt driving device 1, the wheel 7 may be provided at both end portions of the drive roller 2 and the link mechanism 8 may be provided at both sides in the X direction to correspond to the wheels. Similarly to the first end portion 2*b*, the second end portion 2*c* of the drive roller 2 is provided with the wheel 7, the first intermediate member 14, the pin member 15, the second intermediate member 16, the holding member 17, and the spring member 21.

Accordingly, the endless belt 4 may be deviated in either direction, to contact the wheels 7 disposed at both sides, such that power is transmitted by the link mechanism 8, and the first end portion 6*b* or the second end portion 6*c* of the steering roller 6 is pressed downward to tilt the steering roller 6. Accordingly, it is possible to correct the misalignment by returning the endless belt 4 to the opposite side.

An example color image forming apparatus including an intermediate transfer device will be described. As illustrated in FIG. 13, a color image forming apparatus 61 includes the belt driving device 1 as an intermediate transfer device 62. The intermediate transfer device 62 includes the drive roller 2, the suspension roller 3, an intermediate transfer belt 63 which is the endless belt 4, and a secondary transfer roller 64. The secondary transfer roller 64 is disposed to press a sheet which is a recording medium against the intermediate transfer belt 63 moving along the drive roller 2. The color image forming apparatus 61 includes a photosensitive body 65 and has various other components and features. A plurality of the photosensitive bodies 65 are arranged in the movement direction of the intermediate transfer belt 63.

A toner image formed on the photosensitive body 65 is primarily transferred to the intermediate transfer belt 63. The primarily transferred toner image is secondarily transferred to the sheet pressed by the secondary transfer roller 64. The toner image which is secondarily transferred to the sheet is fixed by a fixing device (not illustrated). Further, the intermediate transfer device 62 is provided with a cleaning blade (not illustrated) which removes the residual toner adhering to the intermediate transfer belt 63. The cleaning blade is pressed against the intermediate transfer belt 63 to remove the residual toner.

Since such a color image forming apparatus 61 also includes the belt driving device 1, it is possible to prevent the misalignment of the intermediate transfer belt 63 in the width direction. In the example intermediate transfer device 62, a deformation such as undulation of the intermediate transfer belt 63 may be prevented, so as to further prevent a decrease in adhesion between the cleaning blade and the intermediate transfer belt 63, to remove residual toner, and to improve the image quality.

Another example intermediate transfer device 62 will be described. With reference to FIG. 14, the endless belt 4 of the intermediate transfer device 62 is an intermediate transfer belt to which a toner image is transferred. The endless belt 4 is formed by a resin or elastic body. As the resin which can be applied to the endless belt 4, for example, polyimide, polyamide imide, polyether ether ketone, polyvinylidene difluoride (PVDF), and the like can be exemplified. Further, the surfaces of these resins may be coated with, for example, acrylic or polyurethane. Further, as the elastic body which can be applied to the endless belt 4, for example, rubber type materials such as chloroprene rubber (CR) and nitrile rubber (NBR) can be exemplified.

Further, the end portion 4*d* of the endless belt 4 in the width direction is located outside an image forming area 4*e* in the X direction. The image forming area 4*e* is an area to which the toner image is transferred. A portion corresponding to the end portion 4*d* of the endless belt 4 is thicker than the image forming area 4*e*. Since a reinforcement member 66 is provided at the end portion 4*d* of the endless belt 4, a portion corresponding to the end portion 4*d* of the endless belt 4 is thicker than a portion corresponding to the image forming area 4*e*. The reinforcement member 66 adheres to, for example, the endless belt 4. The reinforcement member 66 may be formed of the same material as that of the endless belt 4 or may be formed of a different material. As the reinforcement member 66, for example, a polyethylene terephthalate (PET) resin, a metal tape, or the like can be used.

The reinforcement member 66 may be located on the outer circumferential surface 4*b* (the front surface) of the endless belt 4, may be located on the inner circumferential surface 4*a* (the rear surface), or may be arranged to cover the end surface 4*c*, for example. The end portion 4*d* may also be made thicker without any reinforcement member 66. Further, the outer circumferential surface of the wheel 7 is disposed at the outside in the radial direction in relation to the surface of the reinforcement member 66 while the endless belt 4 is wound on the drive roller 2. The wheel 7 is able to come into contact with the end surface 4*c* of the endless belt 4 and the reinforcement member 66.

In the intermediate transfer device 62 including such an endless belt 4, since the strength of the end portion 4*d* of the endless belt 4 is increased, the end surface 4*c* can be protected from contact with the wheel 7. Accordingly, it is possible to extend the lifetime of the endless belt 4 and to improve the reliability of the intermediate transfer device 62.

Further, the end portion (or edge portion) 4*d* of the endless belt 4 in the width direction may be formed to be harder than the image forming area 4*e*. As a high hardness treatment, for example, an ultraviolet (UV) curing treatment and a heat curing treatment can be performed. The end portion 4*d* can be cured by irradiating UV rays to the end portion 4*d* to cure the resin. Further, the end portion 4*d* can be cured by heating the resin. Further, a high hardness coating treatment may be performed as the high hardness treatment. As the high hardness coating treatment, for example, silicone resin, glass, or the like may be applied to the surface of the endless belt 4.

It is to be understood that not all aspects, advantages and features described herein may necessarily be achieved by, or included in, any one particular example. Indeed, having described and illustrated various examples herein, it should be apparent that other examples may be modified in arrangement and detail.

For example, a wheel (or pulley) 7 inserted through the end portion of the drive roller 2 has been described, but in other examples of the belt driving device 1, the wheel 7 may be inserted through the suspension roller 3. The steering roller 6 may be disposed on the side of the suspension roller 3. In addition, although in the described examples, the steering roller 6 is disposed at the upper side of the circumferential orbit of the endless belt 4 and comes into contact with the endless belt 4 from below has been described, the steering roller 6 may be located at a lower side of the circumferential orbit of the endless belt 4 and may come into contact with the endless belt 4 from above. Further, in the above-described examples, the steering member has been described as a steering roller, but the steering member may be a bar-shaped member having a curved surface to come into contact with the endless belt or may have other shapes.

The invention claimed is:

1. A belt driving device comprising:

a pair of belt rollers to drive an endless belt, the pair of belt rollers comprising a first roller and a second roller;

wherein the first roller and the second roller extend in a first direction to face each other in a second direction intersecting the first direction;

a steering member located between the first roller and the second roller, the steering member being tiltable about a pivot having a pivot axis that extends in the second direction;

a wheel located at an end portion of the first roller, wherein the wheel protrudes in a radial direction of the first roller, the wheel to be biased by the endless belt, to move outwardly along the first direction with a movement of the endless belt in the first direction; and a link mechanism to tilt the steering member by moving an end portion of the steering member when the wheel moves outwardly in the first direction, wherein a contact length between the steering member and the endless belt in a circumferential direction of the steering member is ¼ or more of a circumference of the steering member.

2. The belt driving device according to claim 1, wherein the steering member is located closer to the first roller than to the second roller.

3. The belt driving device according to claim 1, wherein the end portion of the first roller corresponds to a first end portion, wherein the first roller comprises a second end portion opposite the first end portion, wherein the wheel corresponds to a first wheel and the link mechanism corresponds to a first link mechanism, and wherein the belt driving device comprises a second wheel and a second link mechanism at the second end portion of the first roller.

4. The belt driving device according to claim 1, wherein a direction intersecting the first direction and the second direction is set as a third direction, and the link mechanism to tilt the steering member by moving the end portion of the steering member away from the endless belt in the third direction.

5. The belt driving device according to claim 1, wherein a direction intersecting the first direction and the second direction is set as a third direction, and wherein in a state in which the wheel is not pressed by the endless belt, a contact position between the steering member and the endless belt is deviated in a direction of pressing the endless belt by a maximum strain amount or more of the belt driving device from a position of the endless belt when the steering member does not project in the third direction.

6. The belt driving device according to claim 1, further comprising a first lap amount adjustment roller on an upstream side of the steering roller and a second lap amount adjustment roller on a downstream side of the steering roller, the first lap amount adjustment roller and the second lap amount adjustment roller to press the endless belt downward so that the contact length between the steering member and the endless belt in a circumferential direction of the steering member is ¼ or more of a circumference of the steering member.

7. The belt driving device according to claim 1, wherein the steering member is a steering roller which rotates in a following manner with the movement of the endless belt, and wherein the belt driving device further comprises:

a pair of bearing portions which rotatably supports the steering roller; and a bearing support member extending in a longitudinal direction of the steering roller, to support the pair of bearing portions, and to swing along with the steering roller.

8. The belt driving device according to claim 1, wherein the endless belt is a transfer belt to transfer a toner image.

9. The belt driving device according to claim 8, wherein the transfer belt comprises a resin or an elastic body, and wherein the transfer belt includes an image forming area and an end portion in a width direction of the transfer belt, the end portion is located outside the image forming area in the first direction and the end portion is harder or thicker than the image forming area.

10. The belt driving device according to claim 9, wherein the end portion of the endless belt in the width direction is subjected to a high hardness treatment.

11. The belt driving device according to claim 9, further comprising a reinforcement member at the end portion of the endless belt in the width direction.

12. A belt driving device comprising:

a pair of belt rollers to drive an endless belt, the pair of belt rollers comprising a first roller and a second roller;

wherein the first roller and the second roller extend in a first direction to face each other in a second direction intersecting the first direction;

a steering member located between the first roller and the second roller, the steering member being tiltable about a pivot having a pivot axis that extends in the second direction;

a wheel located at an end portion of the first roller, wherein the wheel protrudes in a radial direction of the first roller, the wheel to be biased by the endless belt, to move outwardly along the first direction with a movement of the endless belt in the first direction; and a link mechanism to tilt the steering member by moving an end portion of the steering member when the wheel moves outwardly in the first direction, wherein a direction intersecting the first direction and the second direction is set as a third direction, and wherein in a state in which the wheel is not pressed by the endless belt, a contact position between the steering member and the endless belt is deviated in a direction of pressing the endless belt from a position of the endless belt when the steering member does not project in the third direction.

13. An imaging system comprising:

a pair of belt rollers to drive an endless belt along a belt path, the pair of belt rollers comprising a first roller and a second roller;

a steering roller located between the first roller and the second roller to engage the endless belt, the steering roller being tiltable;

a wheel located at an end of the first roller in abutment with an edge of the endless belt, the wheel to move along a rotation axis of the first roller, in an outward direction, when the endless belt shifts away from the belt path toward the wheel; and a link mechanism coupled between the wheel and the steering roller to tilt the steering roller in response to a sliding movement of the wheel in the outward direction, in order to urge the endless belt to shift toward the belt path, wherein a contact length between the steering member and the endless belt in a circumferential direction of the steering member is ¼ or more of a circumference of the steering member.

14. The imaging system according to claim 13, wherein the link mechanism comprises:

a shift member coupled with the wheel about an end of the first roller, the shift member to be urged by the wheel in the outward direction, wherein the shift member has a first end and a second end, the second end is positioned between the first end and the endless belt, the shift member has an inclined surface extending between the first end and the second end, and a distance between the inclined surface and the end of the first roller increases from the first end to the second end; and a pivot arm having a first end and a second end opposite the first end relative to a pivot axis of the pivot arm, wherein the first end is coupled with the inclined surface of the shift member, the first end to be urged away from the first roller along the inclined surface when the shift member is moved in the outward direction, and wherein the second end is coupled with an end of the steering roller, the second end to pivot about the pivot axis of the pivot arm, when the first end is moved away from the first roller, in order to urge the steering roller to tilt away from the endless belt.

15. The imaging system according to claim 14, wherein the link mechanism further comprises:

a pin between the shift member and the pivot arm to couple the first end of the pivot arm with the inclined surface.

* * * * *